US005560858A

United States Patent [19]

Fredj et al.

[11] Patent Number: 5,560,858

[45] **Date of Patent: *Oct. 1, 1996**

[54] DYE TRANSFER INHIBITING COMPOSITIONS CONTAINING A METALLOCATALYST, A BLEACH AND POLYAMINE N-OXIDE POLYMER

[75] Inventors: Abdennaceur Fredj, Brussels, Belgium; Frederick E. Hardy, Ponteland; Alan D. Willey, Sandyford, both of Great Britain; James P. Johnston, Overijse, Belgium; Regine Labeque, Brussels, Belgium; Christiaan A. J. K. Thoen, Haasdonk, Belgium

[73] Assignee: The Procter & Gamble Company, Cincinnati, Ohio

[ * ] Notice: The term of this patent shall not extend beyond the expiration date of Pat. No. 5,458,809.

[21] Appl. No.: 432,130

[22] PCT Filed: Nov. 3, 1993

[86] PCT No.: PCT/US93/10543

§ 371 Date: Aug. 28, 1995

§ 102(e) Date: Aug. 25, 1995

[87] PCT Pub. No.: WO94/11477

PCT Pub. Date: May 26, 1994

[51] Int. Cl.[6] ..... C11D 3/28; C11D 3/395; D06L 3/02; D06L 3/16

[52] U.S. Cl. ..... 510/320; 8/111; 8/137; 252/186.39; 252/186.43; 510/392

[58] Field of Search ..... 8/111, 137; 252/102, 252/174.12, 186.39, 186.43, 524, 528, 542, 547

[56] References Cited

U.S. PATENT DOCUMENTS

| | | | |
|---|---|---|---|
| 3,234,139 | 2/1966 | Drew | 252/528 |
| 3,531,526 | 9/1970 | Logan | 252/528 |
| 3,927,967 | 12/1975 | Speakman | 8/103 |
| 4,077,768 | 3/1978 | Johnston et al. | 8/107 |
| 4,240,920 | 12/1980 | deLuque | 252/99 |
| 4,545,919 | 10/1985 | Abel | 252/174 |
| 5,082,585 | 1/1992 | Hessel et al. | 252/174.12 |
| 5,458,809 | 10/1995 | Fredj | 252/542 |
| 5,458,810 | 10/1995 | Fredj | 252/542 |
| 5,466,802 | 11/1995 | Panadiker | 544/193.2 |

FOREIGN PATENT DOCUMENTS

| | | | |
|---|---|---|---|
| 265257 | 4/1988 | European Pat. Off. | C11D 3/37 |
| 538228 | 4/1993 | European Pat. Off. | C11D 3/00 |
| 537381 | 4/1993 | European Pat. Off. | C11D 3/00 |
| 2144721 | 2/1971 | France | C11D 1/66 |
| 2814329 | 10/1979 | Germany | C11D 3/28 |

*Primary Examiner*—Dennis Albrecht

*Attorney, Agent, or Firm*—K. W. Zerby; T. D. Reed; J. J. Yetter

[57] ABSTRACT

A) A metallocatalyst selected from: a) metalloporphin and water-soluble or water-dispersable derivatives thereof; b) metaloporphyrin and water-soluble or water-dispersable derivatives thereof; c) metallophthalocyanine and water-soluble or water-dispersable derivatives thereof; B) a polyamine N-oxide containing polymers; C) an efficient amount of a bleaching agent.

11 Claims, No Drawings

DYE TRANSFER INHIBITING COMPOSITIONS CONTAINING A METALLOCATALYST, A BLEACH AND POLYAMINE N-OXIDE POLYMER

FIELD OF THE INVENTION

The present invention relates to a composition and a process for inhibiting dye transfer between fabrics during washing.

BACKGROUND OF THE INVENTION

One of the most persistent and troublesome problems arising during modern fabric laundering operations is the tendency of some colored fabrics to release dye into the laundering solutions. The dye is then transferred onto other fabrics being washed therewith.

One way of overcoming this problem would be to complex or adsorb the fugitive dyes washed out of dyed fabrics before they have the opportunity to become attached to other articles in the wash.

Polymers have been used within detergent compositions to inhibit dye transfer, such as disclosed in EP-A-102 923, DE-A-2 814 329, FR-A-2 144 721 and EP-265 257.

Copending EP Patent Application 92202168.8 describes dye transfer inhibiting compositions comprising polyamine N-oxides containing polymers.

Another way of overcoming the problem of dye transfer would be to bleach the fugitive dyes washed out of dyed fabrics before they have the opportunity to become attached to other articles in the wash.

Suspended or solubilized dyes can to some degree be oxidized in solution by employing known bleaching agents.

GB 2 101 167 describes a stable liquid bleaching composition containing a hydrogen peroxide precursor which is activated to yield hydrogen peroxide on dilution.

However it is important at the same time not to bleach the dyes actually remaining on the fabrics, that is, not to cause color damage.

U.S. Patent 4,077,768 describes a process for inhibiting dye transfer by the use of an oxidizing bleaching agent together with a catalytic compound such as iron porphins.

Copending EP Patent Application 91202655.6 filed October 9, 1991, relates to dye transfer inhibiting compositions comprising an enzymatic system capable of generating hydrogen peroxide and porphin catalysts.

It has now been surprisingly found that polyamine N-oxide polymers and metallo-catalysts provide superior and synergistic dye transfer inhibiting properties compared to the catalyst- or polymers-system taken alone. This finding allows to formulate compositions which exhibit excellent dye transfer inhibiting properties with low level of catalysts, which in turn, reduces the problem of catalyst deposition onto fabrics.

According to another embodiment of this invention a process is also provided for laundering operations involving colored fabrics.

SUMMARY OF THE INVENTION

The present invention relates to inhibiting dye transfer compositions comprising polyamine N-oxide containing polymers and metallo catalysts and an efficient amount of bleaching agent.

DETAILED DESCRIPTION OF THE INVENTION

Polyamine N-oxide Containing Polymers

The compositions of the present invention comprise as an essential element polyamine N-oxide polymers which contain units having the following structure formula:

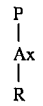

herein

P is a polymerisable unit, whereto the R—N—O group can be attached to or wherein the R—N—O group forms part of the polymerisable unit or a combination of both.

A is

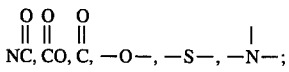

x is or 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

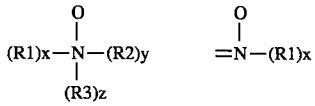

wherein R1, R2, R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both.

Suitable polyamine N-oxides wherein the N—O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine and derivatives thereof.

Another class of said polyamine N-oxides comprises the group of polyamine N-oxides wherein the nitrogen of the N—O group is attached to the R-group.

Other suitable polyamine N-oxides are the polyamineoxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof.

Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 3:1 to 1:1000000. The polymers of the present invention actually encompass random or block copolymers where one monomer type is an amine N-oxide and the other monomer type is an N-oxide or not.

The amine oxide unit of the polyamine N-oxides has a pKa< 10, preferably pKa<7, more preferred pKa<6.

The polyamine oxides can be obtained in almost any degree of polymerisation. The degree of polymerisation is not critical provided the material has the desired water-solubility and dye-suspending power.

Typically, the average molecular weight is within the range of 500 to 1000,000 ; more preferred 1000 to 500,000 ; most preferred 5000 to 100,000.

The polyamine N-oxides of the present invention are typically present from 0.01 to 10% , more preferably from 0.05 to 1%, most preferred from 0.05 to 0.5% by weight of the dye transfer inhibiting composition.

Metallo Catalyst

The preferred usage range of the catalyst in the wash is $10^{-8}$ molar to $10^{-3}$ molar, more preferred $10^{-6}$–$10^{-4}$ molar.

The essential metallo porphin structure may be visualized as indicated in Formula I in the accompanying drawings. In Formula I the atom positions of the porphin structure are numbered conventionally and the double bonds are put in conventionally. In other formula, the double bonds have been omitted in the drawings, but are actually present as in I.

Preferred metallo porphin structures are those substituted at one or more of the 5, 10, 15 and 20 carbon positions of Formula I (Meso positions), with a phenyl or pyridyl substituent selected from the group consisting of

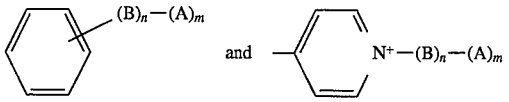

wherein n and m may be 0 or 1; A is selected from water-solubilizing group, e.g., sulfate, sulfonate, phosphate or carboxylate groups; and B is selected from the group consisting of $C_1$–$C_{10}$ alkyl, $C_1$–$C_{10}$ polyethoxy alkyl and $C_1$–$C_{10}$ hydroxy alkyl.

Preferred molecules are those in which the substituents on the phenyl or pyridyl groups are* selected from the group consisting of —$CH_3$, —$C_2H_5$, —$CH_2CH_2CH_2SO_3$—, —$CH_2$——, and —$CH_2CH(OH)CH_2SO_3$—, —$SO_3$.

A particularly preferred metallo phorphin is one in which the molecule is substituted at the 5, 10 15, and 20 carbon positions with the substituent

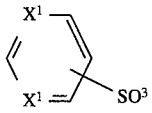

This preferred compound is known as metallo tetrasulfonated tetraphenylporphin. The symbol $X^1$ is (=CY—) wherein each Y, independently, is hydrogen, chlorine, bromine, fluorine or meso substituted alkyl, cycloalkyl, aralkyl, aryl, alkaryl or heteroaryl.

The symbol $X^2$ of Formula I represents an anion, preferably $OH^-$ or $Cl^-$. The compound of Formula I may be substituted at one or more of the remaining carbon positions with $C_1$–$C_{10}$ alkyl, hydroxyalkyl or oxyalkyl groups.

(I)

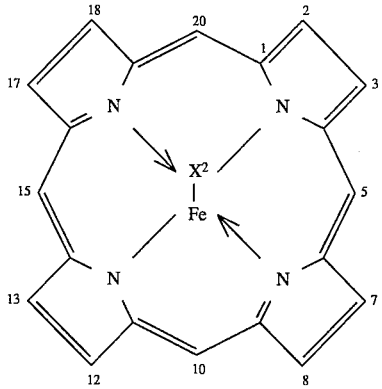

Porphin derivatives also include chlorophyls, chlorines, i.e. isobacterio chlorines and bacteriochlorines.

Metallo porphyrin and water-soluble or water-dispersable derivatives thereof have a structure given in formula II.

(II)

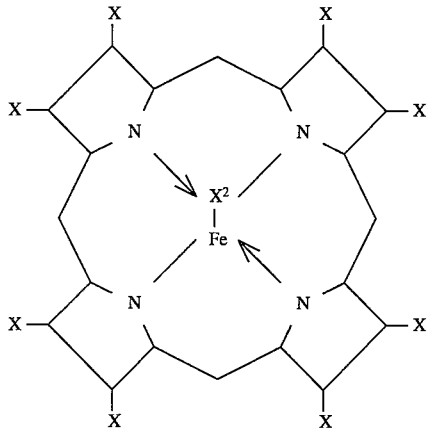

where X can be alkyl, alkyl carboxy, alkyl hydroxyl, vinyl, alkenyl, alkyl sulfate, alkylsulfonate, sulfate, sulfonate, aryl.

The symbol $X^2$ of Formula II represents an anion, preferably $OH^-$ or $Cl^-$.

The symbol X can be alkyl, alkylcarboxy, alkylhydroxyl, vinyl, alkenyl, alkylsulfate, alkylsulfonate, sulfate, sulfonate.

Metallo phthalocyanine and derivatives have the structure indicated in Formula III, wherein the atom positions of the phthalocyanine structure are numbered conventionally. The anionic groups in the above structures contain cations selected from the group consisting of sodium and potassium cations or other non-interfering cations which leave the structures water-soluble. Preferred phthalocyanine derivatives are metallo phthalocyanine trisulfonate and metallo phthalocyanine tetrasulfonate.

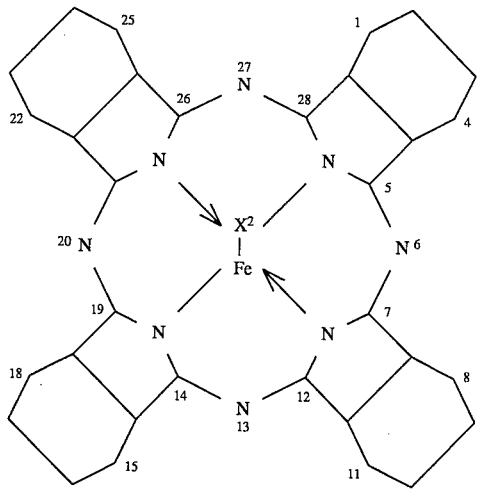

(III)

Another form of substitution possible for the present invention is substitution of the central metal by Fe, Mn, Co Rh, Cr, Ru, Mo or other transition metals.

Still a number of considerations are significant in selecting variants of or substituents in the basic porphin or azaporphin structure. In the first place, one would choose compounds which are available or can be readily synthesized.

Beyond this, the choice of the substituent groups can be used to control the solubility of the catalyst in water or in detergent solutions. Yet again, especially where it is desired to avoid attacking dyes attached to solid surfaces, the substituents can control the affinity of the catalyst compound for the surface. Thus, strongly negatively charged substituted compounds, for instance the tetrasulfonated porphin, may be repelled by negatively charged stained surfaces and are therefore most likely not to cause attack on fixed dyes, whereas the cationic or zwitterionic compounds may be attracted to, or at least not repelled by such stained surfaces.

An Efficient Amount of Bleaching Agent

The dye transfer inhibiting compositions according to the present invention comprise an efficient amount of bleaching agent.

According to the present invention, an efficient amount of bleach is by definition the necessary amount of bleach which combined with a bleach catalyst leads to a level of dye oxidation which is between 40% to 100%, preferably 40% to 60%, more preferred 60% to 80%, most preferred 80%–100% of the maximum (Z) per cent of dye oxidation that can be achieved under the most optimal conditions determined by those skilled in the art.

The bleaches suitable for the present invention can be activated or non-activated bleaches.

Preferably, the bleaches suitable for the present invention include peroxygen bleaches. Examples of suitable water-soluble solid peroxygen bleaches include hydrogen peroxide releasing agents such as hydrogen peroxide, perborates, e.g. perborate monohydrate, perborate tetrahydrate, persulfates, percarbonates, peroxydisulfates, perphosphates and peroxyhydrates. Preferred bleaches are percarbonates and perborates.

The hydrogen peroxide releasing agents can be used in combination with bleach activators such as tetraacetylethylenediamine (TAED), nonanoyloxybenzenesulfonate (NOBS, described in U.S. Pat. No. 4,412,934),3,5,5-trimethylhexanoloxybenzenesulfonate (ISONOBS, described in EP 120,591), or pentaacetylglucose (PAG), which are perhydrolyzed to form a peracid as the active bleaching species, leading to improved bleaching effect.

The hydrogen peroxide may also be present by adding an enzymatic system (i.e. an enzyme and a substrate therefore) which is capable of generating hydrogen peroxide at the beginning or during the washing and/or rinsing process. Such enzymatic systems are disclosed in EP Patent Application 91202655.6 filed Oct. 9, 1991.

Other peroxygen bleaches suitable for the present invention include organic peroxyacids such as percarboxylic acids.

TEST METHODS

For a given catalyst concentration, temperature and pH, the following two test methods can be used to estimate the optimum bleach level that gives the maximum level of dye oxidation, i.e. Z.

(a) In solution dye bleaching:

In a detergent solution, fix the initial concentration of dye (e.g. 40 ppm) and catalyst. Record the absorbance spectrum of this solution using a UV-V is spectrophotometer according to procedures known to those skilled in the art. Add a given concentration of bleach (H2O2, oxone, percarbonate, perborate, activated bleach, etc..) and stir the solution containing the dye and catalyst. After stirring for 30 min, record again the absorbance spectrum of the solution. The amount of dye oxidation can then be determined from the change in the absorbance maximum for the dye. Keeping the experimental conditions the same, vary the amount of bleach so as to achieve the maximum dye oxidation.

(b) Reduction of dye transfer from fabric to another fabric

In either a washing machine or launderometer, add a known bleeding fabric and a known uncolored pick-up tracer (e.g. cotton) to the wash load. After simulating a wash cycle, determine the amount of dye that has been picked up by the tracer according to methods known to those skilled in the art. Now to separate washing machines, add the same amount of bleeding fabric and pick-up tracer, a fixed amount of catalyst and vary the bleach level. Determine the level of dye transfer onto the pick-up tracers and vary the amount of bleach as to minimize dye transfer. In this way the most optimal bleach concentration can be determined.

DETERGENT ADJUNCTS

A wide range of surfactants can be used in the detergent compositions. A typical listing of anionic, nonionic, ampholytic and zwitterionic classes, and species of these surfactants, is given in U.S. Pat. No. 3,664,961 issued to Norris on May 23, 1972.

Mixtures of anionic surfactants are particularly suitable herein, especially mixtures of sulphonate and sulphate surfactants in a weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source preferably from a $C_{16}$–$C_{18}$ fatty source. In each instance the cation is an alkali metal, preferably sodium. Preferred sulphate surfactants are alkyl sulphates having from 12 to 18 carbon atoms in the alkyl radical, optionally in admixture with ethoxy sulphates having from 10 to 20, preferably 10 to 16 carbon atoms in the alkyl radical and an average degree of ethoxylation of 1 to 6. Examples of preferred alkyl sulphates herein are tallow alkyl sulphate, coconut alkyl sulphate, and $C_{14-15}$ alkyl sulphates. The cation in each instance is again an alkali metal cation, preferably sodium.

One class of nonionic surfactants useful in the present invention are condensates of ethylene oxide with a hydrophobic moiety to provide a surfactant having an average hydrophiliclipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–8 moles of ethylene oxide per mole of alcohol, particularly the $C_{14}$–$C_{15}$ primary alcohols containing 6–8 moles of ethylene oxide per mole of alcohol and the $C_{12}$–$C_{14}$ primary alcohols containing 3–5 moles of ethylene oxide per mole of alcohol.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent are disclosed in EP-B 0 070 077, 0 075 996 and 0 094 118.

Also suitable as nonionic surfactants are poly hydroxy fatty acid amide surfactants of the formula $$R^2-\underset{\underset{O}{\|}}{C}-\underset{\underset{R^1}{|}}{N}-Z,$$

wherein $R^1$ is H, or $R^1$ is $C_{1-4}$ hydrocarbyl, 2-hydroxy ethyl, 2-hydroxy propyl or a mixture thereof, $R^2$ is $C_{5-31}$ hydrocarbyl, and Z is a polyhydroxyhydrocarbyl having a linear hydrocarbyl chain with at least 3 hydroxyls directly connected to the chain, or an alkoxylated derivative thereof. Preferably, $R^1$ is methyl, $R^2$ is a straight $C_{11-15}$ alkyl or alkenyl chain such as coconut alkyl or mixtures thereof, and Z is derived from a reducing sugar such as glucose, fructose, maltose, lactose, in a reductive amination reaction.

The compositions according to the present invention may further comprise a builder system. Any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylenephosphonic acid. Though less preferred for obvious environmental reasons, phosphate builders can also be used herein.

Suitable builders can be an inorganic ion exchange material, commonly an inorganic hydrated aluminosilicate material, more particularly a hydrated synthetic zeolite such as hydrated zeolite A, X, B or HS.

Another suitable inorganic builder material is layered silicate, e.g. SKS-6 (Hoechst). SKS-6 is a crystalline layered silicate consisting of sodium silicate ($Na_2Si_2O_5$).

Suitable polycarboxylates builders for use herein include citric acid, preferably in the form of a water-soluble salt, derivatives of succinic acid of the formula R—CH(COOH)CH2(COOH) wherein R is C10–20 alkyl or alkenyl, preferably C12–16, or wherein R can be substituted with hydroxyl, sulfo sulfoxyl or sulfone substituents. Specific examples include lauryl succinate , myristyl succinate, palmityl succinate2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10–18 fatty acids, as well as well as the corresponding soaps.

Preferred saturated species have from 12 to 16 carbon atoms in the alkyl chain. The preferred unsaturated fatty acid is oleic acid.

Preferred builder systems for use in granular compositions include a mixture of a water-insoluble aluminosilicate builder such as zeolite A, and a watersoluble carboxylate chelating agent such as citric acid.

Other builder materials that can form part of the builder system for use in granular compositions the purposes of the invention include inorganic materials such as alkali metal carbonates, bicarbonates, silicates, and organic materials such as the organic phosphonates, amiono polyalkylene phosphonates and amino polycarboxylates.

Other suitable water-soluble organic salts are the homo- or co-polymeric acids or their salts, in which the polycarboxylic acid comprises at least two carboxyl radicals separated from each other by not more than two carbon atoms.

Polymers of this type are disclosed in GB-A-1,596,756. Examples of such salts are polyacrylates of MW 2000–5000 and their copolymers with maleic anhydride, such copolymers having a molecular weight of from 20,000 to 70,000, especially about 40,000.

Detergency builder salts are normally included in amounts of from 10% to 80% by weight of the composition preferably from 20% to 70% and most usually from 30% to 60% by weight.

Other components used in detergent compositions may be employed, such as bleaches, suds boosting or depressing agents, enzymes and stabilizers or activators therefor, soil-suspending agents soil-release agents, optical brighteners, abrasives, bactericides, tarnish inhibitors, coloring agents, and perfumes.

Especially preferred are combinations with technologies which also provide a type of color care benefit. Examples of these technologies are polyvinylpyrrolidone polymers and other polymers which have dye transfer inhibiting properties. Another example of said technologies are cellulase for color maintenance/rejuvenation.

Other examples are polymers disclosed in EP 92870017.8 filed Jan. 31, 1992 and enzyme oxidation scavengers disclosed in EP 92870018.6 filed Jan. 31, 1992. also particularly suitable are amine base catalyst stabilizers disclosed in EP 92870019.4 filed Jan. 31, 1992.

The detergent compositions according to the invention can be in liquid, paste or granular forms. Granular compositions according to the present invention can also be in "compact form", i.e. they may have a relatively higher density than conventional granular detergents, i.e. from 550 to 950 g/l; in such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt. The liquid compositions according to the present invention can also be in "compact form", in such case, the liquid detergent compositions according to the present invention will contain a lower amount of water, compared to conventional liquid detergents.

The present invention also relates to a process for inhibiting dye transfer from one fabric to another of solubilized and suspended dyes encountered during fabric laundering operations involving colored fabrics.

The process comprises contacting fabrics with a laundering solution as hereinbefore described.

The process of the invention is conveniently carried out in the course of the washing process. The washing process is preferably carried out at 5° C. to 75° C., especially 20 to 60, but the polymers are effective at up to 95° C. The pH of the treatment solution is preferably from 7 to 11, especially from 7.5 to 10.5.

The process and compositions of the invention can also be used as additive during laundry operations.

The following examples are meant to exemplify compositions of the present invention, but are not necessarily meant to limit or otherwise define the scope of the invention, said scope being determined according to claims which follow.

EXAMPLE I

The extent of dye transfer from different colored fabrics was studied using a launder-o-meter test which simulates a 30 min wash cycle. The launder-o-meter beaker contains 200 ml of a detergent solution (pH 7.5–10.5), a 10×10 cm piece of the colored fabric and a multi-fiber swatch which is used as a pick-up tracer for the bleeding dye. The multifiber swatch consists of 6 strips (1.5 cm×1.5 cm each) made of different materials (polyacetate, cotton, polyamide, polyester, wool and orlon) which were sewn together.

The extent of dye transfer is reported in terms of the c value which represents the change in the Hunter a, b values and is defined by the following equation:

$$\Delta C=\{(a_f a_i)^2+(b_f-b_i)^2\}^{1/2}$$

where the subscripts i and f refer to the Hunter value before and after washing in the presence of the bleeding fabric, respectively.

EXAMPLE I(a)

poly (4-vinylpyridine-N-oxide) and FeTPPS

The experimental conditions are:

A:detergent solution without any dye transfer inhibition system.

B:detergent solution containing 10 ppm of Iron-tetrasulfonated phenylporphyrin (FeTPPS) and the optimum level of bleach as determined from the test method above.

C:detergent solution containing 10 ppm of poly(4-vinylpyridine-N-oxide)(PVNO).

D:detergent solution containing 10 ppm of FeTPPS and 10 ppm of poly(4-vinylpyridine-N-oxide).

| | Δ C value on cotton | | | |
|---|---|---|---|---|
| Fabric | A | B | C | D |
| blue sweater | 15.2 | 14.7 | 8.2 | 4.8 |
| purple trousers-1 | 19.3 | 7.0 | 17.8 | 2.8 |

-continued

| | Δ C value on cotton | | | |
|---|---|---|---|---|
| Fabric | A | B | C | D |
| green sweater | 8.7 | 8.4 | 6.6 | 4.5 |
| purple jogging | 12.7 | 12.2 | 7.6 | 5.7 |
| purple trousers | 14.5 | 13.1 | 6.4 | 4.3 |
| blue trousers | 18.7 | 13.9 | 22.2 | 10.8 |

The higher the ΔC value, the more dye transferred onto the pick-up swatch.

Conclusion

The dye transfer inhibition benefits from the combined PVNO and FeTPPS are in all cases better than benefits provided by either the catalyst or polymer alone. In addition, not only additive effects are observed but these results show true synergism between the catalyst and poly(4-vinylpyridine-N-oxide).

EXAMPLE I(b)

poly (4 -vinylpyridine-N-oxide) and MnPc

The experimental conditions are:

A:detergent solution without any dye transfer inhibition system.

B:detergent solution containing 10 ppm of Mn-Phthalocyanine tetrasulfonated (MnPC) and the optimum level of bleach as determined from the test method above.

C:detergent solution containing 10 ppm of poly(4-vinylpyridine-N-oxide). (PVNO)

D:detergent solution containing 10 ppm of MnPc and 10 ppm of poly(4-vinylpyridine-N-oxide).

| | Δ C values on cotton | | | |
|---|---|---|---|---|
| Fabric | A | B | C | D |
| blue sweater | 15.2 | 14.7 | 8.2 | 4.8 |
| green sweater | 8.7 | 8.4 | 6.6 | 4.5 |
| purple jogging | 12.7 | 12.2 | 7.6 | 5.7 |
| purple trousers | 14.5 | 13.1 | 6.4 | 4.3 |

Conclusion

The dye transfer inhibition benefits from the combined PVNO and MnPC are in all cases better than benefits provided by either the catalyst or polymer alone. In addition, these results show true synergism between the catalyst and poly(4-vinylpyridine-N-oxide).

EXAMPLE II (A/B/C/D)

A liquid dye transfer inhibiting composition according to the present invention is prepared, having the following compositions:

| | |
|---|---|
| Linear alkyl benzene sulfonate | 10 |
| Sodium $C_{12-15}$ alkyl sulfate | 3 |
| $C_{14-15}$ alkyl 2.5 times ethoxylated sulfate | 0 |
| $C_{12}$ glucose amide | 0 |
| $C_{12-15}$ alcohol 7 times ethoxylated | 11.6 |
| Oleic acid | 2.5 |
| Citric acid | 1 |
| $C_{12-14}$ alkenyl substituted succinic acid | 0 |
| Sodium Hydroxide | 3.5 |
| Ethanol | 6 |
| Monoethanolamine | 0 |
| Triethanolamine | 6.4 |

-continued

| | |
|---|---|
| 1,2-propane diol | 1.5 |
| Glycerol | 0 |
| Boric acid | 0 |
| Diethylene triamine penta (methylene phosphonic acid) | 0.8 |
| $CaCl_2$ | 0 |
| Soil release polymers | 0.5 |
| Fatty acids | 12 |
| Enzymes | 0.65 |
| Water and minors | Balance to 100% |

The above composition was supplemented with the catalyst, polymer and bleach according to table I

TABLE I

| | A | B | C | D |
|---|---|---|---|---|
| Catalyst 1: Mn-tetrasulfonated tetraphenylporphine | 0 | 0.05 | 0 | 0 |
| Catalyst 2: Cr-tetrasulfonated tetraphenylporphine | 0 | 0 | 0.100 | 0 |
| Catalyst 3: Fe tetrasulfonated tetraphenylporphine | 0 | 0 | 0 | 0.2 |
| Catalyst 4: Mn-Phthalocyanine tetrasulfonated | 0.15 | 0.0 | 0 | 0 |
| $H_2O_2$ | 0.3–0.5 | 0 | 0 | 0 |
| Perborate | 0 | 0 | 1–5 | 0.5 |
| Percarbonate | 0 | 0.4 | 0 | 0.100– |
| Poly(4-vinylpyridine-N-oxide) | 0.1 | 0.3 | 0.05 | 0.2 |
| TAED | 0 | 0 | 0.5 | 0 |

EXAMPLE III (A/B/C/D)

A compact granular dye transfer inhibiting composition according to the present invention is prepared, having the following formulation:

| | % |
|---|---|
| Linear alkyl benzene sulphonate | 11.40 |
| Tallow alkyl sulphate | 1.80 |
| $C_{45}$ alkyl sulphate | 3.00 |
| $C_{45}$ alcohol 7 times ethoxylated | 4.00 |
| Tallow alcohol 11 times ethoxylated | 1.80 |
| Dispersant | 0.07 |
| Silicone fluid | 0.80 |
| Trisodium citrate | 14.00 |
| Citric acid | 3.00 |
| Zeolite | 32.50 |
| Maleic acid actylic acid copolymer | 5.00 |
| DETMPA | 1.00 |
| Cellulase (active protein) | 0.03 |
| Alkalase/BAN | 0.60 |
| Lipase | 0.36 |
| Sodium silicate | 2.00 |
| Sodium sulphate | 3.50 |
| Minors | up to 100 |

The above composition was supplemented with the catalyst, polymer and bleach according to table II

TABLE II

| | A | B | C | D |
|---|---|---|---|---|
| Catalyst 1: Mn-tetrasulfonated tetraphenylporphine | 0 | 0.05 | 0 | 0 |
| Catalyst 2: Cr-tetrasulfonated tetraphenylporphine | 0 | 0 | 0.100 | 0 |
| Catalyst 3: Fe-tetrasulfonated tetraphenylporphine | 0 | 0 | 0 | 0.2 |
| Catalyst 4: Mn-Phthalocyanine tetrasulfonated | 0.15 | 0.0 | 0 | 0 |

TABLE II-continued

| | A | B | C | D |
|---|---|---|---|---|
| $H_2O_2$ | 0.3–0.5 | 0 | 0 | 0 |
| Perborate | 0 | 0 | 1–5 | 2.5 |
| Percarbonate | 0 | 0.4 | 0 | 0 |
| Poly(4-vinylpyridine-N-oxide) | 0.05 | 0.1 | 0.15 | 0.2–0.4 |
| TAED | 0 | 0 | 0.5 | 1.0 |

We claim:

1. A dye transfer inhibiting composition comprising:

A. a metallo catalyst selected from a) metallo porphin and water-soluble or water-dispersable derivatives thereof, b) metallo porphyrin and water-soluble or water-dispersable derivatives thereof, c) metallo phthalocyanine and water-soluble or water-dispersable derivatives thereof, wherein the wash concentration of metallo catalyst is from $10^{-8}$ to $10^{-3}$ molar, B. from 0.01% to 10% of polyamine N-oxide containing polymers having a ratio of amine to amine N-oxide of 10:1 to 1:1,000,000. and an average molecular weight within the range of 500 to 1,000,000;

C. an efficient mount of a bleaching agent which, combined with the metallo catalyst, leads to a level of dye oxidation between 40% to 100% of maximum dye oxidation.

2. A dye transfer inhibiting composition according to claim 1 containing a metallo porphin derivative, wherein said porphin is substituted on at least one of its meso positions with a phenyl or pyridyl substituent selected from the group consisting of

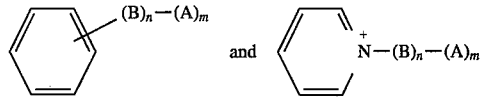

wherein n and m may be 0 or 1, A is selected from the water-solubilizing group, e.g., sulfate, sulfonate, phosphate, and carboxylate groups, and B is selected from the group consisting of $C_1$–$C_{10}$ alkyl, $C_1$–$C_{10}$ polyethoxyalkyl and $C_1$–$C_{10}$ hydroxyalkyl.

3. A dye transfer inhibiting composition according to claim 2 wherein the substituents on the phenyl or pyridyl groups are selected from the group consisting of —$CH_3$, —$C_2H_5$, —$CH_2CH_2CH_2SO_3$—, —$CH_2COO$—, —$CH_2CH(OH)CH_2SO_3$—, and —$SO_3$.

4. A dye transfer inhibiting composition according to claim 1, containing a metallo porphin derivative, wherein said metallo porphin is substituted on at least one of its meso positions with a phenyl substituent selected from the group consisting of

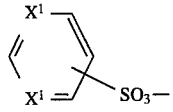

wherein $X^1$ is (=CY—) wherein each Y, independently, is hydrogen, chlorine, bromine or meso substituted alkyl, cycloalkyl, aralkyl, aryl, alkaryl or heteroaryl.

5. A dye transfer inhibiting composition according to claim 1 wherein the central atom is selected from Fe, Mn, Co, Rh, Cr, Ru, Mo or other transition metals.

6. A dye transfer inhibiting composition according to claim 1 wherein the wash concentration of metallo catalyst is from $10^{-8}$ to $10^{-3}$ molar, preferably from $10^{-6}$ to $10^{-4}$ molar.

7. A dye transfer inhibiting composition according to claim 1 wherein the polyamine N-oxide is polyvinylpyridine N-oxide.

8. A dye transfer inhibiting composition according to claim 1 wherein the bleaching agent is selected from an activated or a non-activated bleach.

9. A dye transfer inhibiting composition according to claim 1 which is a detergent additive, in the form of a non-dusting granule or a liquid.

10. A detergent composition which comprises an effective amount of a dye transfer inhibiting composition according to any of the preceding claims further comprising effective amounts of at least one of the following: enzymes, surfactants, and/or builders.

11. A detergent composition which comprises a dye transfer inhibiting composition according to any of the preceding claims further comprising a cellulase in an amount sufficient to enhance fabric color maintenance and/or rejuvenation.

* * * * *